US009396719B2

(12) United States Patent
Klier

(10) Patent No.: US 9,396,719 B2
(45) Date of Patent: Jul. 19, 2016

(54) METHOD AND DEVICE FOR SYNTHETIC GENERATION OF AN ACOUSTIC SIGNAL

(71) Applicant: Lear Corporation, Southfield, MI (US)

(72) Inventor: Markus Klier, Kueps (DE)

(73) Assignee: Lear Corporation, Southfield, MI (US)

( * ) Notice: Subject to any disclaimer, the term of this patent is extended or adjusted under 35 U.S.C. 154(b) by 207 days.

(21) Appl. No.: 14/102,041

(22) Filed: Dec. 10, 2013

(65) Prior Publication Data

US 2014/0161276 A1 Jun. 12, 2014

(30) Foreign Application Priority Data

Dec. 11, 2012 (DE) ..... 10 2012 112 107

(51) Int. Cl.
*G10K 15/02* (2006.01)

(52) U.S. Cl.
CPC ..... *G10K 15/02* (2013.01)

(58) Field of Classification Search
CPC ..... G10K 15/02
IPC ..... G10K 15/02
See application file for complete search history.

(56) References Cited

U.S. PATENT DOCUMENTS 5,754,094 A * 5/1998 Frushour ..... G10K 15/02 104/296
6,230,140 B1 5/2001 Severson et al.
8,855,325 B2 10/2014 Vogel et al.

FOREIGN PATENT DOCUMENTS

DE 102005012463 B3 6/2006
DE 102007055477 A1 5/2009
DE 102010043973 A1 5/2012

* cited by examiner

*Primary Examiner* — Ping Lee
(74) *Attorney, Agent, or Firm* — MacMillan, Sobanski & Todd, LLC

(57) ABSTRACT

A method and a device for synthetic generation of an acoustic signal, proceeding from a control signal (AS) or a detection signal which is fed as input signal to a device for generating the acoustic signal, wherein at least one electromechanical transducer generates the acoustic signal by means of an electrical transducer excitation signal.

18 Claims, 1 Drawing Sheet

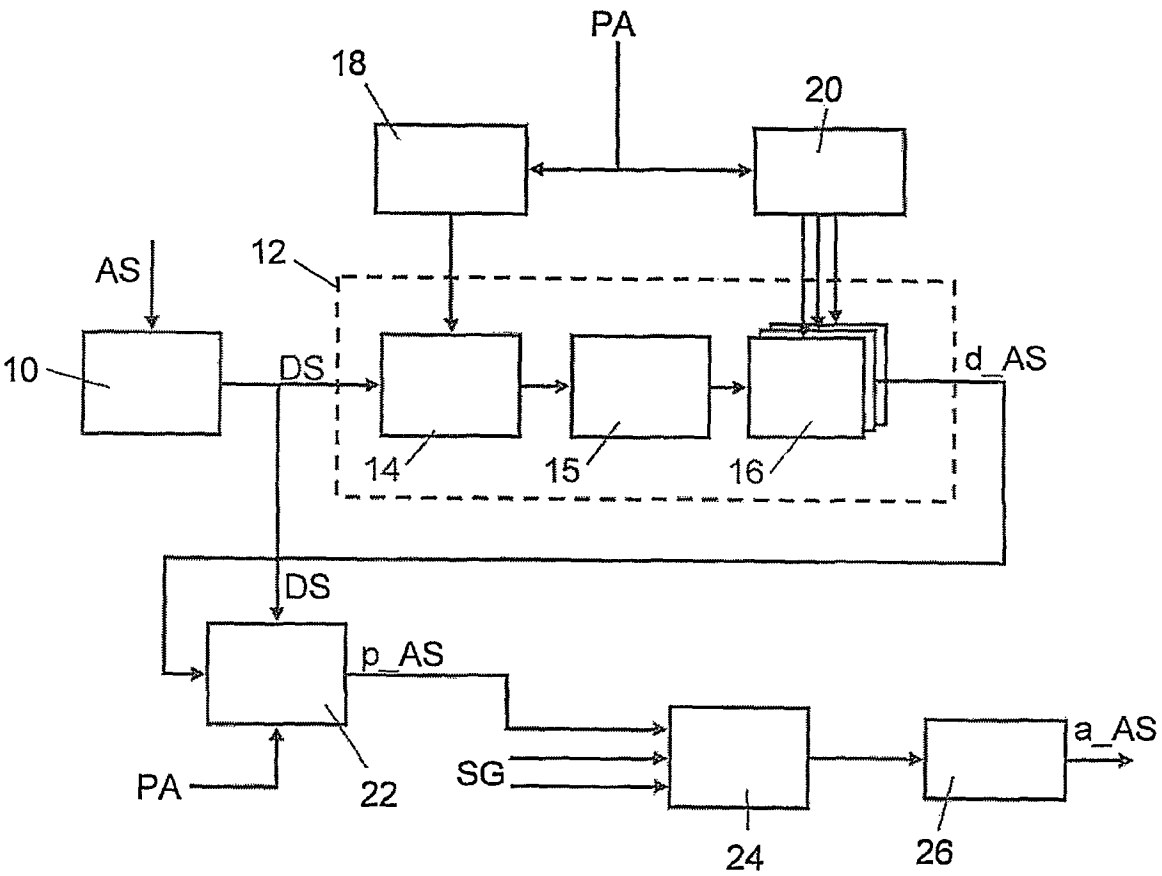
PA
20
18
12
AS
10
DS
14
15
16
d_AS
DS
p_AS
22
PA
SG
24
26
a_AS

METHOD AND DEVICE FOR SYNTHETIC GENERATION OF AN ACOUSTIC SIGNAL

BACKGROUND OF THE INVENTION

The present invention relates to a method and a device for synthetic generation of an acoustic signal, e.g. in a vehicle. A control signal for controlling a motor or a detection signal, which detects the engine speed for example, is fed as input signal to a device for generating the acoustic signal, wherein at least one electromechanical transducer generates the acoustic signal by means of an electrical transducer excitation signal. To this end, an electromechanical transducer can be a loudspeaker or an exciter which generates sound waves at components of a vehicle.

The present invention relates to a method and a device for synthetic generation of an acoustic signal, e.g. in a vehicle. A control signal for controlling a motor or a detection signal, which detects the engine speed for example, is fed as input signal to a device for generating the acoustic signal, wherein at least one electromechanical transducer generates the acoustic signal by means of an electrical transducer excitation signal. To this end, an electromechanical transducer can be a loudspeaker or an exciter which generates sound waves at components of a vehicle.

It is already well known to artificially generate engine sounds of an internal combustion engine or engine in general in a motor vehicle or to amplify the engine sounds of an internal combustion engine through various devices and methods and to change their tone in a particular manner. This is often accomplished using a particular structural design of the components of the engine or exhaust gas system, wherein it is moreover also possible to integrate electromechanical transducers (exciters or loudspeakers) in the exhaust gas system of a motor vehicle having an internal combustion engine for example in order to adapt the sound waves naturally generated by the internal combustion engine to a desired sound through sound waves generated by the exciter or loudspeaker.

It is furthermore well known to equip electric vehicles or hybrid vehicles that can often be operated only by means of an electric motor or also in electric mode with a sound that resembles that of an internal combustion engine. On the one hand, this should increase the purchase and acceptance of these types of vehicles by customers and also increase safety for other road users, such as pedestrians or bicyclists, who are accustomed to motor vehicles having a typical engine sound which thereby also warns them about this motor vehicle (e.g. when crossing a street).

However, the difficulty lies in generating an engine sound that sounds as natural as possible and corresponds to the engine sound of a conventional motor vehicle having an internal combustion engine without sounding monotone. Devices known in the art for generating artificial engine sounds often sound synthetic.

A method for synthetic generation of engine sounds, especially of an internal combustion engine, in which a sequence of successively generated signal sequence sections of particular sequence time intervals form a transducer excitation signal is known from DE 10 2007 055 477 A1. To this end, the engine sounds are formed from the transducer excitation signal. A sequence of successively generated signal sequence sections having particular sequence time intervals form the transducer excitation signal, wherein each signal sequence section consists of successive signal segments as signal oscillations of particular sequence time intervals, and wherein the sum of the sequence time intervals of the signal segments contained in a signal sequence section determines the sequence time interval of the assigned signal sequence section and at least two signal segments in a signal sequence section are unequal in regard to their segment time intervals and/or segment amplitudes. In the method described in DE 10 2007 055 477 A1, the transducer excitation signal is nevertheless calculated as a function of the number of cylinders of an internal combustion engine to be imitated.

DE 10 2005 012 463 B3 describes a method for generating an engine sound of a motor vehicle having an additional sound generated by an actuator and a device for carrying out the method, wherein in a data memory of a control unit for the generation, there is stored an engine characteristic map in which level values evaluated through boundary conditions are stored at engine speed nodes, these level values being stored as multiples of half the engine speed for defined engine speeds and their assigned oscillations and orders. The stored level values corresponding to the current speed signal and therefore to the current engine speed and its higher orders are then read from the data memory and transmitted to an arithmetic unit of the control unit, wherein an actuator excitation signal as a continuous time signal in the manner of a harmonic series is calculated from the level values and the actuator excitation signal is formed therefrom. The actuator excitation signal is then outputted via a power amplifier to the actuator as an electric actuator signal, wherein the actuator converts the electric actuator signal into a vibratory force in the manner of an electrodynamic vibrator.

DE 10 2010 043 973 A1 discloses the generation of a sound for a motor vehicle driven by an electric motor, wherein a control signal for an electric motor or for the electric motor's power electronics is generated, the control signal having a modulation for sound generation and the control signal controlling the electric motor, wherein the modulation in the electric motor generates vibrations which produce the sound.

Furthermore known from the state of the art are methods and devices in which, proceeding from a vehicle-specific parameter (rotary frequency, speed, engaged gear, etc.), a sound assigned to this operating state is read from a memory and outputted through a loudspeaker or exciter.

A disadvantage of the methods and devices known from the state of the art, however, is that they cannot approximately generate the natural sound of an internal combustion engine, above all because they generate strictly periodic signals and sounds or generate signals and sounds that have repeating components. This also applies to DE 10 2007 055 477 A1, which indeed makes use of different segment time intervals and/or segment amplitudes for two signal segments within one signal sequence section, but severely limits the number of signal sequence sections and number of signal segments in the signal sequence sections, thereby again producing very artificially sounding sounds.

It is therefore the objective of the present invention to present a method and a device in which an acoustic signal is synthetically generated, wherein the generated acoustic signal is to sound very natural and no complex calculations need to be made.

The objective is accomplished by a method having the characteristics stated herein and by a device having the characteristics stated herein.

Advantageous modifications are disclosed in detail in the claims.

SUMMARY OF THE INVENTION

The method for synthetic generation of an acoustic signal in a vehicle, proceeding from a control signal for controlling a motor or proceeding from a detection signal, wherein the control signal or the detection signal is fed as input signal to a device for generating the acoustic signal and at least one electromechanical transducer generates the acoustic signal by means of an electrical transducer excitation signal, features the following steps:

- transformation of the control signal or the detection signal into a corresponding digital input signal by a mapping function.
- calculating an address and an address increment from the digital input signal with the aid of at least one vehicle-specific parameter, wherein the at least one vehicle-specific parameter is used for frequency and/or phase modulation.
- readout of data corresponding to the calculated address from a memory by a modulo operation in which for each of a multiplicity of addresses there is stored a multiplicity of acoustic signals having small frequency and/or amplitude differences, wherein the acoustic signals assigned to one address are selected randomly and as a function of the at least one vehicle-specific parameter and are integrated into one digital output signal, wherein the acoustic signals are divided into groups and/or have a specific weighting and the acoustic signals are selected from particular groups or from acoustic signals having a particular specific weighting when defined values formed from at least one vehicle-specific parameter are exceeded or undershot, and the selected acoustic signals compose a particular portion of the digital output signal formed by the acoustic signals.
- conversion of the integrated digital output signal into an analog output signal and
- feeding of the analog output signal as a transducer excitation signal to at least one electromechanical transducer.

The method is characterized in that in one operating state of a vehicle, random acoustic signals are read from a memory and integrated into one digital output signal instead of reading and repeatedly outputting one acoustic signal (e.g. a "sound" or a "sound file") from a memory in a particular operating state of a vehicle as long as this operating state is maintained. In addition, the selection is carried out encompassing acoustic signals as a function of vehicle-specific parameters or one vehicle-specific parameter on the basis of the weighting of individual acoustic signals or on the basis of the weighting of individual groups. This occurs in that a particular operating state of a vehicle arises during acceleration of the vehicle, for example, and a particular address is therefore assigned to the digital input signal, wherein this operating state can also appear during braking of a vehicle, but because of the position of the accelerator or brake pedal (or on account of other vehicle-specific values or parameters) the acoustic signals will be increasingly read and played back from this one address or played back more frequently than the other acoustic signals assigned to this address. A digital output signal, which consists of acoustic signals and sounds substantially more natural, is thereby generated. Thus in one case, all of the acoustic signals assigned to one address can be randomly selected with the same probability, but wherein the randomness can also relate only to individual groups or categories of stored, weighted acoustic signals, wherein particular acoustic signals can then be selected more often than others. Moreover, a multiplicity of these types of acoustic signals assigned to one address can be stored in a memory, thereby making it relatively improbable that one acoustic signal will be selected twice during the selection of one address on the basis of one operating state. But particular rules which further define the selection of the individual acoustic signals can also be applied in the method (e.g. an acoustic signal can be called upon to form the digital output signal a second time only if at least two other different acoustic signals have been selected after the first selection).

Moreover, the selection and the playback or integration into one digital output signal is affected based on the vehicle-specific parameters. This occurs on the basis of the groups which have particular acoustic signals or on the basis of individual acoustic signals, wherein their weighting decreases or increases. To this end the vehicle-specific parameters determine the selection of an address on one hand and then also determine the frequency at which individual acoustic signals assigned to one address are selected on the other hand. This produces a composition of a digital output signal which is/sounds very similar to natural sounds.

Thus acoustic signals which correspond to an engine sound with different ignition behaviors can also be assigned to one address for example. These different ignition behaviors, which may also differ only slightly, will then be taken into consideration in the random playback.

The integrated digital output signal and/or the analog output signal can also be amplified, in another method step.

Moreover the acoustic signals can also be band-limited, wherein the band limiting can also occur for the digital output signal generated or integrated from the acoustic signals. Band limiting can be determined on the basis of the following formula, which is required to observe the Nyquist criterion:

$$f_{Signal} \cdot p \cdot 2 \leq f_S$$

$f_{Signal}$: frequency of the input signal p: factor that indicates the frequency change $f_S$: sampling frequency where $f_{signal}$ is the frequency of the input signal, p is a factor which indicates the frequency change and $f_S$ is the sampling rate frequency or sampling frequency or sampling rate.

Processing of the digital input signal can also be carried out in a plurality of parallel processing paths, wherein the integrated digital output signals or the analog output signals are subsequently mixed and integrated.

To this end, the digital input signal, which is generated from a transformation of the frequency of the control signal or the detection signal, is processed in parallel processing steps, wherein there occurs a parallel calculation of an address and an address increment, a parallel readout of data corresponding to the calculated address, and an integration of the acoustic signals.

The processed output signals which lie below an audible threshold due to amplitude modulation cannot be calculated in the method, wherein they are set to "0". This can occur for example if the acoustic output is inaudibly faint or very faint due to the digital output signal or analog output signal. This enables the computation effort for the processing to be further reduced.

After the readout of the address from the memory and the integration of the digital output signal, it is possible to carry out another processing step in which the integrated digital output signal is filtered (by IIR and FIR filters for example) as a function of the digital input signal and subjected to an amplitude, frequency and/or phase modulation as a function of the vehicle-specific parameters. This allows sounds that are more natural to be generated, since the acoustic signals outputted by the electromechanical transducer or the sounds outputted by the electromechanical transducer do not contain any repeating signal forms or acoustic signal parts.

Synthetically generated sounds or sound components can be mixed with the signals during signal processing, wherein the synthetically generated sounds or sound components can be generated from another arrangement for the signal generation. To this end, synthetically generated sounds or sound components can continue to be stored in the memory and, after the generation of a digital output signal, be mixed with the digital output signal. It is thus possible to store sounds which are mixed with the integrated digital output signals during full braking or when the accelerator is completely actuated.

The conversion of the control signal or detection signal into the digital input signal can be carried out using a transformation table.

For an analog control or detection signal, a transformation of the frequency of the analog control signal or detection signal can also occur.

The control signal or detection signal can be present both as digital and as analog. The control signal can thus be formed from an engine sound of an internal combustion engine. In further developments, the control signal or the detection signal can also be data which are obtained via the CAN bus (digital) or for example from a Hall-effect sensor of a flywheel or from an engine speed sensor (analog). The transformation of the frequency of an analog control signal into a corresponding digital control signal can be accomplished for example in that a signal for an electric motor having a rotary frequency of zero is transformed into a frequency which corresponds to the idle speed frequency of an internal combustion engine.

It is moreover possible to calculate a "virtual transmission" from the vehicle-specific parameters rotary frequency (e.g. of the wheels or drive shaft of an electric vehicle), load (such as the load of an electric motor) and speed of the electric vehicle, wherein the engine speed of an internal combustion engine (hybrid/electric vehicle) which is inactive or not present in the vehicle can be calculated on the basis of the above vehicle-specific parameters. Furthermore, if transformation ratios are stored in a memory, it is then possible to calculate other engine speeds of an inactive or non-present internal combustion engine. It is thus possible to calculate engine speeds of an internal combustion engine and use them for the synthetic generation of an acoustic signal, wherein the vehicle does not have an internal combustion engine or the internal combustion engine is inactive (e.g. serial hybrid vehicle in which the internal combustion engine essentially has the same engine speed).

Moreover when the defined values are exceeded or undershot, the acoustic signals from particular groups and/or the acoustic signals having a particular specific weighting can increasingly be selected over acoustic signals from other groups or acoustic signals having another weighting and be integrated into the digital output signal. In this connection, "increasingly" means that a division can occur in which a particular portion is preferably selected on the basis of the vehicle-specific parameters and the remaining part of the acoustic signals is randomly put together from the other acoustic signals stored in the address.

The invention furthermore relates to a device for synthetic generation of an acoustic signal, proceeding from a control signal for controlling a motor or proceeding from a detection signal, wherein the control signal or the detection signal is fed as input signal to the device for generating the acoustic signal and wherein at least one electromechanical transducer generates the acoustic signal by means of an electromechanical transducer excitation signal.

A device of this type demonstrates a first transformation unit in which the control signal or the detection signal is converted into a digital input signal. Moreover, the device demonstrates a calculation unit in which an address and an address increment are calculated from the digital input signal with the aid of at least one vehicle-specific parameter, wherein the at least one vehicle-specific parameter is used for frequency and/or phase modulation. The device furthermore comprises a memory unit within which for a multiplicity of addresses there are stored a multiplicity of data which comprise the acoustic signals having small frequency and/or amplitude differences, and a selection unit which randomly and as a function of the at least one vehicle-specific parameter selects and integrates into one digital output signal the acoustic signals assigned to one address. To this end, the acoustic signals are divided into groups within the memory unit and/or have a specific weighting and the acoustic signals from particular groups or acoustic signals having a particular specific weighting are selected when defined values which are formed from at least one vehicle-specific parameter are exceeded or undershot. These then form a larger portion of the digital output signal formed by the acoustic signals. The device finally comprises a second transformation unit in which integrated digital output signals are converted into an analog output signal, wherein the device is designed to carry out one of the methods described above.

A device can yet demonstrate at least one amplifier, a signal combiner and/or at least one processing unit in which the vehicle-specific parameters, the digital input signal and/or synthetic sounds can be mixed and integrated with the output signal or digital output signal.

To this end, a transformation of the frequency of an analog control signal or of an analog detection signal into a digital input signal can take place in the first transformation unit.

To this end, electromechanical transducers of the device can be a loudspeaker or an exciter which introduces sound waves into components of the vehicle for generation of sounds.

The acoustic signals assigned to one address can differ according to the driving situation and can be stored into a memory accordingly.

Further advantages and characteristics as well as embodiments of the invention arise from the figure which is illustrated in the drawing and depicts one embodiment of the invention for sake of example. To this end, the illustrated embodiment is not to be understood as limiting and serves merely to describe the invention.

Various aspects of this invention will become apparent to those skilled in the art from the following detailed description of the preferred embodiment, when read in light of the accompanying drawings.

BRIEF DESCRIPTION OF THE DRAWINGS

FIG. 1 is diagram for illustrating the method.

DETAILED DESCRIPTION OF THE PREFERRED EMBODIMENT

The diagram in FIG. 1 illustrates the method of operation or method for generating artificial sounds by way of example. In a first step, there takes place a frequency transformation (illustrated by block 10) of a control signal AS. The control signal AS is a signal for controlling a motor. The control signal AS is typically provided from vehicle-specific data (CAN bus; Hall-effect sensor; engine speed sensor, etc.), which describe at least the current operating state of an engine or are illustrative/representative for this state.

The frequency of the control signal AS is converted into a digital input signal DS by means of a transformation table.

The digital input signal DS is then fed to a method step for determining an acoustic signal 12 (illustrated by the dashed line wherein the two blocks 18 and 20 are also taken into consideration in determining an acoustic signal). To this end, there occurs an address calculation 14 (illustrated by block 14). In the address calculation 14, an address is calculated from the digital input signal DS with the aid of at least one vehicle-specific parameter PA, wherein the address is an address for data stored in a memory. The vehicle-specific parameters PA are the modulators of a frequency or phase modulation (block 18). The vehicle-specific parameters PA modulate the address calculation/the address increment. To this end, the vehicle-specific parameters PA are obtained from devices in the vehicle which record vehicle-specific parameters PA. The vehicle-specific parameters PA for example can include the speed of the vehicle, the rotary frequency of the vehicle's wheels or of a drive shaft as well as the engine speed. The vehicle-specific parameters PA can also be the load of an electric motor or an internal combustion engine of a vehicle. To this end, the vehicle-specific parameters PA are used for calculating the address and an address increment and fed to the processing block 18 and also to the selection of an acoustic signal in a processing block 20. In addition, the vehicle-specific parameters PA can also be used for processing 22 (illustrated by block 22) a digital output signal d_AS.

In the address calculation 14, an address increment is additionally determined from the digital input signal DS provided for example that an address determination for a digital input signal DS has already occurred previously. Afterwards there follows an assignment 15 (illustrated by block 15) of an address for which a multiplicity of acoustic signals is stored into a memory. To this end, the acoustic signals that are stored for the particular address are read from a memory (readout illustrated by block 16). To this end the readout 16 likewise occurs as a function of the vehicle-specific parameters PA, wherein these parameters affect the frequency of occurrence of the selected data. Thus after the assignment 15 of an address, acoustic signals which have only small frequency and/or amplitude differences are read from a memory. A digital output signal d_AS is formed from these acoustic signals. In contrast to the method known from the prior art, a digital output signal d_AS is formed from the acoustic signals having the low frequency and/or amplitude differences rather than reading only one acoustic signal which is repeatedly outputted as long as a certain state is maintained or the address assignment is maintained, wherein the frequency of occurrence and the sequence order of the acoustic signals assigned to this address occur randomly. But additionally a selection takes place on the basis of vehicle-specific parameters PA, thereby affecting the frequency at which particular acoustic signals are selected.

For this the acoustic signals have a particular weighting on the basis of which a selection occurs or the acoustic signals are combined into groups inside the address or assigned to groups which likewise have a certain weighting. In the selection 20, the determined vehicle-specific parameters PA are analyzed, evaluated in relation to driving state or operating states or other characteristics (e.g. acceleration or braking, engaged gear) or values are determined from them, and the selection and frequency at which particular acoustic signals are selected are determined from them. If for example a particular value is determined for the vehicle-specific parameters PA during the selection 20 and two groups of acoustic signals are assigned to one address, then if this value is exceeded the acoustic signals from a first group will be called upon more often for the formation of the digital output signal d_AS than the acoustic signals stored in the second group. Of course, a plurality of groups with different weightings can be stored for each address. Moreover, the acoustic signals can also each have a weighting, wherein all acoustic signals whose weighting exceeds a certain value (formed by the vehicle-specific parameters PA) are selected more often than the acoustic signals whose weightings lie below this value. Thus a division of 40% to 60% or of 30% to 70% can be realized for example. However other divisions are also conceivable.

Subsequently, the digital output signal d_AS is formed from the particular weighted acoustic signals, wherein for example acoustic signals are selected randomly and arbitrarily from a first group of acoustic signals and acoustic signals are selected arbitrarily and randomly from a second group of acoustic signals and wherein the division in the digital output signal d_AS amounts to 40% to 60%.

As described above, other divisions can also occur. It is also possible to form a plurality of groups on the basis of which there occurs a division such as 20% to 60% to 20% for example.

Subsequently, a digital output signal d_AS which is subjected to further processing (illustrated by block 22 processing) is formed from the selected acoustic signals. In this postprocessing of the digital output signal d_AS in block 22, there occurs a phase, amplitude and/or frequency modulation, wherein the vehicle-specific parameters PA are modulators for the phase, amplitude and/or frequency modulation of the digital output signal d_AS. The digital input signal DS is a parameter for FIR or IIR filters which are applied to the digital output signal d_AS.

The processed output signal p_AS is then integrated with synthetic sounds SG in another method step 24 (illustrated by block 24 mixing and integration) and converted into an analog output signal a_AS in another processing step 26 (transformation 26). This can be accomplished via a digital-to-analog converter for example. The analog output signal a_AS is then fed as transducer excitation signal to an electromechanical transducer (not illustrated), which can be embodied as loudspeaker and outputs the analog output signal a_AS or the transducer excitation signal as sound waves. These sound waves can be an artificially generated engine sound for a motor vehicle for example.

Moreover other modulation or filtering steps can also be provided in the processing steps of the method, or the signals can be band-limited. But it is additionally possible to amplify the integrated digital output signal d_AS, the processed output signal p_AS and/or the analog output signal a_AS before it is outputted by an electromechanical transducer.

A synthetically generated sound, which is stored in a memory and corresponds for example to the components of an exhaust gas system of a motor vehicle, can also be fed to the processed output signal p_AS as synthetic sounds SG.

In the method, the assignment of the address from the digital input signal DS occurs by means of a modulo operation in which defined addresses can be assigned to the digital input signals DS. Advantageously, it is not necessary to execute any expensive arithmetic operations in the described method, thereby substantially reducing the demands on a processor that carries out the method. The requirements on a memory are also reduced, since only small or short acoustic signals need to be stored for each address, in contrast to large sound files.

In the method as described above, these small sound snippets are selected randomly taking vehicle-specific parameters PA into consideration, thereby as a rule not generating a sound which contains repeating components. An essentially more natural engine sound for motor vehicles is therefore provided. This is preferably suitable for electric or hybrid vehicles, which have no internal combustion engine or alternatively can run in a pure electric mode in which the internal combustion engine is not in operation or in operation only with minor load and is therefore also silent.

Moreover the method and a correspondingly designed device can be used in a motor vehicle having an internal combustion engine, wherein certain sounds can be generated in addition to the sounds of the internal combustion engine.

A device for synthetic generation of acoustic signals in a vehicle demonstrates for this purpose at least one first transformation unit (such as an analog-to-digital converter), a calculation unit, a memory unit, a selection unit and a second transformation unit (such as a digital-to-analog converter). However, the different units can also be combined into one unit and/or form part of a higher-order system. Thus it is also possible to produce a device of this type which is implemented in existing devices (control units for motor vehicles). An implementation of the device for synthetic generation of acoustic signals is therefore also opportune because devices or sensors in the vehicle record the vehicle-specific parameters PA and the control signal AS anyway and relay them to at least a control unit. The acoustic signals stored in the memory can also be stored in a memory of a unit which is present in the vehicle anyway or stored on a data carrier (DVD, memory board, USB stick, etc.). It is thereby also possible to store on the memory acoustic signals which were downloaded or acquired by a user and implement them in the system. Moreover, if the driver changes the vehicle model, it is additionally possible for example to convert the sound characteristics of the vehicle or of the engine.

LIST OF REFERENCE CHARACTERS

10 Frequency transformation
12 Determination of an acoustic signal
14 Address calculation
15 Assignment
16 Readout
18 F/P modulation
20 Selection
22 Processing
24 Mixing and integrating
26 Transformation
AS Control signal
DS Digital input signal
PA Parameters
d_AS Digital output signal
p_AS Processed output signal
a_AS Analog output signal
SG Synthetic sounds

What is claimed is:

1. Method for synthetic generation of an acoustic signal, proceeding from a control signal (AS) for controlling a motor or proceeding from a detection signal, wherein the control signal (AS) or the detection signal is fed as input signal to a device for generating the acoustic signal and at least one electromechanical transducer generates the acoustic signal by means of an electrical transducer excitation signal, comprising the following steps:

transformation of the control signal (AS) or the detection signal into a digital input signal (DS) by a mapping function;

calculating an address and an address increment from the digital input signal (DS) with the aid of at least one vehicle-specific parameter (PA), wherein the at least one vehicle-specific parameter (PA) is used for frequency and/or phase modulation, readout of data corresponding to the calculated address from a memory in which for each of a multiplicity of addresses there is stored a multiplicity of acoustic signals having small frequency and/or amplitude differences and the readout taking a modulo operation into account, wherein the acoustic signals assigned to one address are selected randomly and as a function of the at least one vehicle-specific parameter (PA) and are integrated into one digital output signal (d_AS), wherein the acoustic signals are divided into groups and/or have a specific weighting and the acoustic signals are selected from particular groups or from acoustic signals having a particular specific weighting when defined values formed from at least one vehicle-specific parameter (PA) are exceeded or undershot, and the selected acoustic signals compose a particular portion of the digital output signal (d_AS) formed by the acoustic signals, conversion of the integrated digital output signal (d_AS) into an analog output signal (a_AS), and feeding of the analog output signal (a_AS) as a transducer excitation signal to at least one electromechanical transducer.

2. Method according to claim 1, wherein the integrated digital output signal (d_AS) and/or the analog output signal (a_AS) are amplified.

3. Method according to claim 1, wherein the acoustic signals are band-limited.

4. Method according to claim 3, wherein the band limiting is determined by the following formula:

$$f_{signal} \cdot p \cdot 2 \leq f_S$$

$f_{Signal}$: frequency of the input signal
p: factor that indicates the frequency change
$f_s$: sampling frequency.

5. Method according to claim 1, wherein a processing of the digital input signal (DS) is carried out in a plurality of parallel processing paths and the integrated digital output signals (d_AS) or the analog output signals (a_AS) are subsequently mixed and integrated.

6. Method according to claim 1, wherein processed output signals (p_AS) which lie below an audible threshold due to amplitude modulation are not calculated.

7. Method according to claim 1, wherein after the readout of the address from the memory and the integration of the digital output signal (d_AS), another processing step is carried out in which the integrated digital output signal (d_AS) is filtered as a function of the digital input signal (DS) and subjected to an amplitude, frequency and/or phase modulation as a function of the vehicle-specific parameters (PA).

8. Method according to claim 1, wherein synthetically generated sounds (SG) or sound components are mixed with the digital output signals, the processed output signals and/or the analog output signals (d_AS; p_AS; a_AS) during the signal processing, wherein the synthetically generated sounds (SG) or sound components are generated from another arrangement for the signal generation.

9. Method according to claim 1, wherein event-specific sounds, which are assigned to a vehicle-specific event, are mixed with the analog output signal (a_AS) and/or with the digital output signal (d_AS; p_AS) if a corresponding vehicle-specific event occurs.

10. Method according to claim 9, wherein a virtual transmission is formed from vehicle-specific parameters (PA) and the rotary frequency for various gears is calculated on the basis of the virtual transmission to generate a synthetically generated sound (SG).

11. Method according to claim 1, wherein the vehicle-specific parameters (PA) comprise the rotary frequency and/or the load of an electric motor, of an internal combustion engine, of a transmission and/or of other components of a vehicle and/or the speed of a vehicle.

12. Method according to claim 1, wherein an interpolation for the acoustic signals stored in the memory is carried out as a function of parts of the address index.

13. Method according to claim 1, wherein the conversion of the control signal (AS) into the digital input signal (DS) is carried out using a transformation table.

14. Method according to claim 1, wherein a transformation of the frequency of an analog control signal (AS) or analog detection signal into a digital input signal (DS) is carried out.

15. Method according to claim 1, wherein when the defined values are exceeded or undershot, the acoustic signals from particular groups and/or the acoustic signals having a particular specific weighting are increasingly selected over acoustic signals from other groups or acoustic signals having another weighting and are integrated into the digital output signal (d_AS).

16. Device for synthetic generation of an acoustic signal, proceeding from a control signal (AS) for controlling a motor or proceeding from a detection signal, wherein the control signal (AS) or the detection signal is fed as input signal to the device for generating the acoustic signal and at least one electromechanical transducer generates the acoustic signal by means of an electromechanical transducer excitation signal, comprising a first transformation unit in which the control signal (AS) or the detection signal is converted into a digital input signal (DS), a calculation unit in which an address and an address increment are calculated from the digital input signal (DS) with the aid of at least one vehicle-specific parameter (PA), wherein the at least one vehicle-specific parameter (PA) is used for frequency and/or phase modulation, a memory unit within which for a multiplicity of addresses there are stored a multiplicity of data which comprise the acoustic signals having small frequency and/or amplitude differences, a selection unit which randomly and as a function of the at least one vehicle-specific parameter (PA) selects and integrates into one digital output signal (d_AS) the acoustic signals assigned to one address, wherein the acoustic signals are divided into groups within the memory unit and/or have a specific weighting and the acoustic signals from particular groups or acoustic signals having a particular specific weighting are selected when defined values which are formed from at least one vehicle-specific parameter (PA) are exceeded or undershot and these selected acoustic signals make up a larger portion of the digital output signal (d_AS) formed by the acoustic signals, and a second transformation unit in which integrated digital output signals (d_AS) are converted into an analog output signal (a_AS) to be output by the transducer.

17. Device according to claim 16, further comprising an amplifier, a signal combiner and/or at least one processing unit in which the vehicle-specific parameters (PA), the digital input signal (DS) and/or synthetic sounds can be mixed and integrated with the output signal or digital output signal (d_AS).

18. Device according to claim 16, wherein a transformation of the frequency of an analog control signal (AS) or of an analog detection signal into a digital input signal takes place in the first transformation unit.

* * * * *